United States Patent [19]

Belanger et al.

[11] 4,006,562

[45] Feb. 8, 1977

[54] DOOR SYSTEM WITH IMPROVED WEATHERSEAL

[75] Inventors: Nicholas E. Belanger, Troy; Floyd Bentley, Pontiac; David C. Geoffrey, Troy, all of Mich.

[73] Assignee: The Stanley Works, New Britain, Conn.

[22] Filed: Jan. 2, 1976

[21] Appl. No.: 646,179

[52] U.S. Cl. ..... 49/380; 49/470; 49/489; 49/495; 49/498

[51] Int. Cl.[2] ..... E06B 1/00; E06B 7/16

[58] Field of Search ..... 49/380, 470, 478, 479, 49/489, 495, 498, 475

[56] References Cited

UNITED STATES PATENTS

| | | | |
|---|---|---|---|
| 3,448,543 | 6/1969 | Multer | 49/470 |
| 3,469,349 | 9/1969 | Multer | 49/478 |
| 3,553,301 | 1/1971 | Reardon et al. | 49/479 X |
| 3,851,420 | 12/1974 | Tibbetts | 49/380 X |

*Primary Examiner*—Philip C. Kannan

[57] ABSTRACT

An improved weathersealed door system includes a sill and a cooperating weatherseal member which has a tubular depending portion deflected by the sill in the closed position so as to provide firm surface engagement therewith. A header weatherseal member extends across the top edge of the door and is also resiliently deflected in the closed position of the door. Extending vertically along the hinge side of the door is a first hinge jamb weatherseal member which seats against the surface of the door in its closed position, and a second hinge jamb weatherseal member extends upwardly from the sill and is fabricated of highly compressible material of greater thickness than the space between the side edge of the door and the jamb. As a result, it is compressed by both the side edge of the door and the sill weatherseal member when the door is in its closed position.

On the latch side, there is mounted on the jamb a first latch jamb weatherseal member which extends from adjacent the header to a point spaced above the sill. This member has a first portion physically mounted on the jamb and a deflectable portion which engages the surface of the door in its closed position and which also provides an internal channel at least adjacent the sill end thereof. A second latch jamb weatherseal member is mounted below the first member and extends upwardly from the sill; its cross section provides a body portion, a deflectable lip portion projecting laterally towards the door and an interseal portion projecting up into the channel of the first member. This second latch jamb weatherseal member is fabricated of highly compressible material which is compressed by the door and sill weatherseal members in the closed position thereof and the lip portion abuts the side edge of the door.

21 Claims, 14 Drawing Figures

DOOR SYSTEM WITH IMPROVED WEATHERSEAL

BACKGROUND OF THE INVENTION

In many building structures it is most desirable to provide a good seal about the edges of doors so as to prevent or limit the flow of air and thereby reduce heating or cooling costs or eliminate drafts. With exterior doors, it is also extremely desirable to provide such sealing action to prevent passage of rain, snow or other wind driven material into the building structure.

As a result, many techniques have been developed for providing seals of varying effectiveness about the doors. In metal clad doors, there are frequently utilized weatherseal members containing strips of magnetic material so that the weatherstrips magnetically engage the upper edge and the jamb side edge portions of the door. A particularly acute problem has been found in attempting to provide good weathersealing action adjacent the sill or threshold. Many weatherstrips have been designed which provide fairly effective sealing action along the surface of the sill but frequently the effectiveness of the sealing action is destroyed in the area adjacent the jambs. Among the many sill structures which have been suggested and widely employed are sills having drain or weep holes spaced along the length thereof which allow water pentrating the outer seals to drain into an internal cavity which in turn drains through the outward side of the sill.

It is an object of the present invention to provide an improved weathersealed door system wherein highly effective weatherseal members are employed to effectively preclude passage of rain or the like about the entire periphery of the door.

It is also an object to provide such a door system in which the several weatherseal members may be readily fabricated from synthetic resins or natural resilient materials and may be readily assembled.

Another object is to provide such a door system which may either use or omit strips of magnetic material to enhance sealing action along the top and latch side edge portions of the door.

Still another object is to provide such a door system in which multiple lines of sealing contact are provided along the several edges of the door.

SUMMARY OF THE INVENTION

It has now been found that the foregoing and related objects can be readily attained in a weathersealed door system having a door frame including a pair of spaced jambs, a sill and a header. A door is pivotally mounted in the frame by hinge means mounting one side edge portion of the door to one of the jambs for pivotal movement from a first position within the frame to a second position wherein the opposite side edge portion of the door is disposed outwardly therefrom. A sill weatherseal member extends along the bottom edge of the door and has a tubular depending portion extending along the width of the door and of a height greater than the spacing between the bottom edge of the door and the sill. As a result, it is deflected into close engagement with the surface of the sill in the first position of the door.

A header weatherseal member extends across the top edge of the door and is resiliently deflected in the first position of the door to provide a good weatherseal. A first hinge jamb weatherseal member extends along the jamb to which the hinge means is mounted from the header weatherseal member to the sill, and a second hinge jamb weatherseal member extends upwardly from the sill adjacent the first hinge jamb weatherseal member. This second weatherseal member is fabricated of highly compressible material and is of a thickness greater than the spacing between the side edge of the door and the jamb so that it is compressed when the door is in the first position by both the side edge of the door and the sill weatherseal member.

A first latch jamb weatherseal member on the jamb opposite that having the hinge means mounted thereon extends from adjacent the header to a point spaced above the sill and has a cross section providing a first portion mounted on the jamb and a deflectable portion laterally therefrom for engagement with the surface of the door in the first position thereof. Its cross section also provides an internal channel at least adjacent the sill end thereof. A second latch jamb weatherseal member is also mounted on this jamb and extends upwardly from the sill below the first latch jamb weatherseal member. Its cross section provides a body portion, a deflectable lip portion projecting laterally from the body portion towards the door and an interseal portion projecting upwardly into the channel in the first latch jamb weatherseal member. The second latch jamb weatherseal member is fabricated of highly compressible material and is compressed by the door in the first position thereof with the lip portion abutting the side edge of the door.

In the preferred embodiment, the sill weatherseal member tubular depending portion is of generally rectangular cross section with the lower face thereof snugly seating against the cooperating face of the sill, and the sill has a ledge extending along the length thereof at its inner edge with a second depending portion on the weatherseal member abutting the surface of the ledge and extending therebelow. In addition, the sill weatherseal member has a resiliently deflectable tab portion and the sill has a step therein against which this tab bears. Desirably, the sill weatherseal member has an intermediate depending portion of a height greater than the spacing between the door and the sill and which is deflected into close engagement with the surface of the sill in the closed door position. The sill weatherseal member is of greater transverse dimension than the thickness of the door so as to project beyond the principal surfaces thereof and provide water deflectors.

The header weatherseal member has a mounting portion for attachment to the header and a tubular portion at the free end thereof, most desirably with a resiliently deflectable bellows portion therebetween. A strip of magnetic material may be provided within the tubular portion to magnetically engage the ferrous skin of the door.

The first hinge jamb weatherseal member has a cross section providing a mounting portion and a compressible tubular portion, which in turn desirably has a resiliently deflectable finger portion at the edge thereof spaced from the jamb and towards the door, so that it is inwardly deflected by the door in its closed position. The second hinge jamb weatherseal member extends over substantially the entire thickness of the door from adjacent the first hinge jamb weatherseal member.

The first latch jamb weatherseal member deflectable portion includes a tubular portion at the end thereof and most desirably a bellows portion between the first portion and the tubular portion. The tubular portion may have a strip of magnetic material therein, and it desirably has a deflectable finger projecting from the edge thereof spaced from the jamb and the first position so that it is deflected into surface contact with the door in its closed position. The jamb weatherseal member cross section provides a mounting portion projecting laterally from the body portion in the direction opposite from the lip portion, and the deflectable lip portion has a vertical surface adjacent the edge of the door tapering to a reduced cross section at the free end thereof.

DETAILED DESCRIPTION OF THE ILLUSTRATED EMBODIMENT

Figure 1:
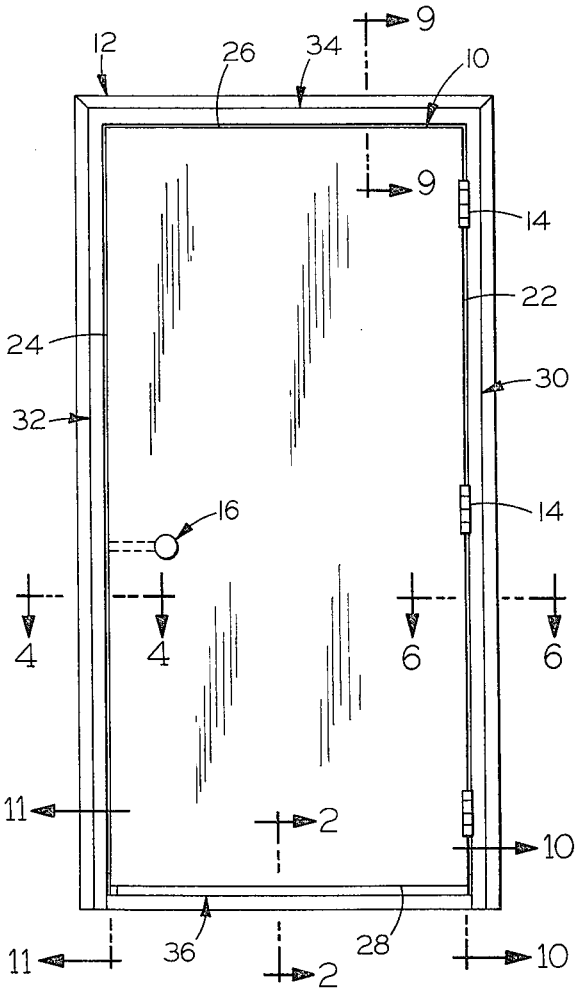
FIG. 1 is a front elevational view of a door system embodying the present invention.

Turning now to FIG. 1 of the attached drawings in detail, therein illustrated is a door system embodying the present invention wherein a door generally designated by the numeral 10 is mounted for pivotal movement inwardly of the building within a frame generally designated by the numeral 12 by the hinges 14. The door is designed to be latched and locked in place by a knob and latch assembly generally designated by the numeral 16.

Figure 2:
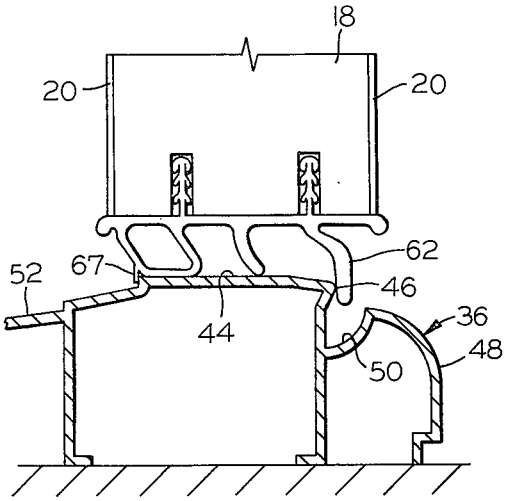
FIG. 2 is a fragmentary sectional view of the door system to an enlarged scale along the line 2—2 of FIG. 1.

As seen in FIG. 2, the door 10 is of a conventional metal clad construction including a wood core 18 and metal skins 20 which extend thereabout. In accordance with conventional practice, the hinges 14 are mortised into the hinge side edge 22 of the door 10 so as to minimize the spacing between the side edge 22 of the door 10 and the frame 12. As is conventional, there is a spacing between the latch side edge 24 and the frame 12 as well as between the top edge 26 and bottom edge 28 and their respective portions of the door frame 12.

The door frame 12 is comprised of the hinge jamb generally designated by the numeral 30, latch jamb generally designated by the numeral 32, header generally designated by the numeral 34 and sill generally designated by the number 36, as seen in FIGS. 4–11. The jambs 30, 32 and header 34 are each provided with a stop 40, 38 and 42, respectively.

Turning now to the sill 36 which is shown in detail in FIG. 2, it is conventionally formed as an integral extrusion with a platform portion 44 over which the door 10 is located in its closed position and having a projecting ledge 46 adjacent the inner edge thereof. The inner portion 48 of the sill 36 is configured to provide a drain channel 50 below the ledge 46. At the outer edge of the sill 36 is inclined portion 52 which may vary in configuration depending upon the construction intended.

Figure 3:
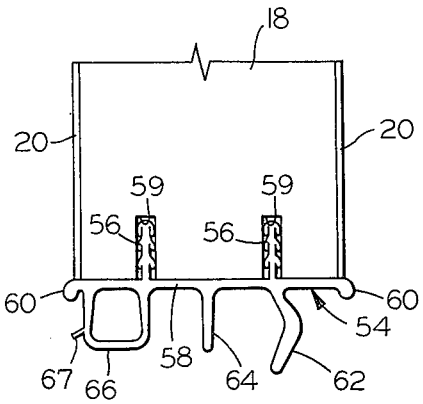
FIG. 3 is a similar fragmentary sectional view showing the sill weatherseal member in the undeflected condition.

As best seen in FIGS. 2 and 3, extending across the bottom edge 28 of the door 10 is the sill weatherseal member generally designated by the numeral 54 and integrally formed of synthetic resin. A pair of barbed tails 56 extend upwardly from the horizontally disposed body portion 58 which abuts the bottom edge 28 of the door 10 and frictionally seat within the channels or grooves 59 routed into the bottom edge 28 of the door 10. At the inner and outer edges of the body portion 58 are enlarged lip portions or deflectors 60 which project slightly beyond the faces of the door 10. Depending from the body portion 58 of the weatherseal member 54 is a first or inner leg portion 62 which is of greater height than the spacing between the bottom edge 28 and the platform 44 of the sill 36 and it is so located as to project downwardly past and abut the edge of the ledge 46 of the platform 44.

Spaced outwardly from the first leg portion 62 is the middle leg portion 64 which is also of greater height than the spacing between the bottom edge 28 and the platform 44 so that it is deflected when the door 10 is in the closed position as seen in FIG. 2 and abuts the platform 44 adjacent the central portion thereof. Adjacent the outer edge of the weatherseal member 54 is the depending tubular portion 66 which is also of greater height than the spacing between the bottom edge 28 and platform 44 so that it too is deflected when the door 10 is in the closed position as seen in FIG. 2. An inwardly and downwardly inclined tab 67 on the inner surface of the tubular portion 66 abuts the outer edge of the platform 44 in the closed position of the door 10 as seen in FIG. 2.

Figure 9:
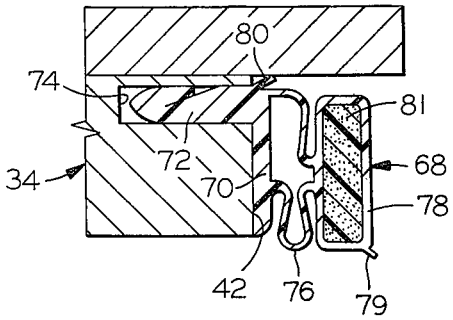
FIG. 9 is a fragmentary sectional view to an enlarged scale along the line 9—9 of FIG. 1 but with the door removed.

As best seen in FIG. 9, extending across the header 34 is a header weatherseal member generally designated by the numeral 68 and integrally formed from synthetic resin with a body portion 70 and a barbed tail 72 extending into the channel 74 of the stop 42. A bellows portion 76 interconnects the body portion 70 with the tubular box portion 78 which is provided with a downwardly and outwardly projecting finger 79 at the outer lower edge thereof. An upwardly projecting tab 80 on the upper edge of the body portion 70 abuts the header 34. In this embodiment, a magnetic strip 81 is disposed within the box portion 78 to firmly grip the surface of the metal skin 20 of the door 10.

Figure 5:
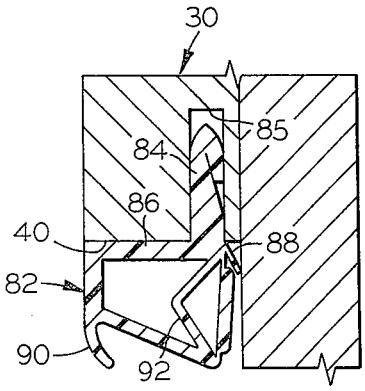
FIG. 5 is a fragmentary sectional horizontal view of the weatherseal member at the hinge side of the door system with the weatherseal member in the undeflected condition and drawn to an enlarged scale.
Figure 8:
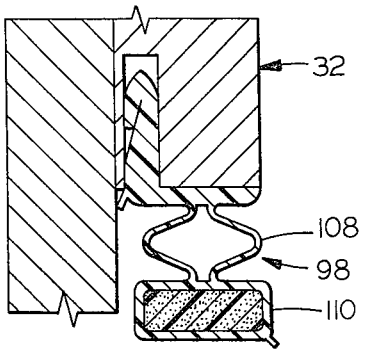
FIG. 8 is a fragmentary sectional view similar to FIG. 4 but with the door open so that the weatherseal member is in an undeformed condition.
Figure 6:
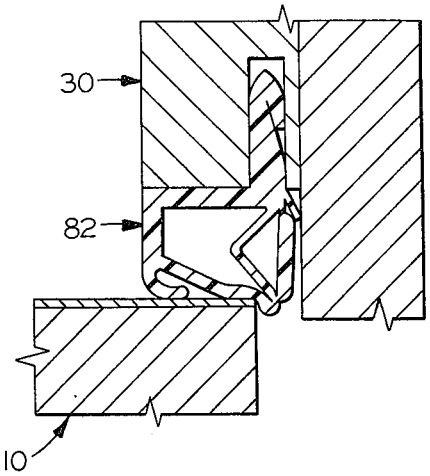
FIG. 6 is a similar view along the line 6—6 of FIG. 1 showing the weatherseal member deformed by the door in its closed position.
Figure 10:
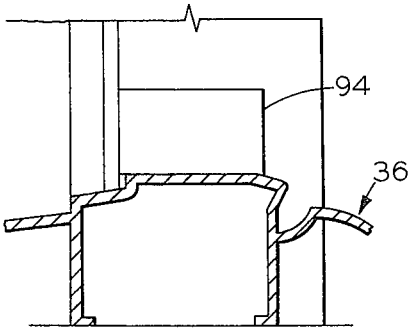
FIG. 10 is a fragmentary sectional view to an enlarged scale adjacent the sill and along the line 10—10 of FIG. 1.

Turning now to FIGS. 5, 6 and 10, therein illustrated are the weatherseal members utilized at the hinge side edge 22 of the door 10. Extending from the header weatherseal member 68 downwardly to the sill 36 at the inner end of the platform 44 thereof is the first hinge jamb weatherseal member generally designated by the numeral 82 which is integrally formed with a barbed tail 84 extending inwardly into the channel 85 from the generally inverted U-shaped body portion 86. The leg of the body portion 86 adjacent the jamb 30 has a portion of reduced thickness adjacent the base of the body portion 86 for a purpose to be described hereinafter and a relatively thin finger portion 88 projects from this juncture along the side of the leg towards the jamb 30.

The other leg of the U-shaped body portion 86 has a curved deflectable finger portion 90 which is curved in the direction of the jamb 30. A generally Z-shaped web portion 92 extends between the outer end of the leg of the body portion spaced from the jamb 30 and the juncture between the other leg and the base of the body portion 86 to provide a readily deflectable construction. As seen in FIG. 5, the Z-shaped web portion 92 is joined to the outer end of the other leg of the U-shaped body portion adjacent its outer end by a thin section.

Figure 7:
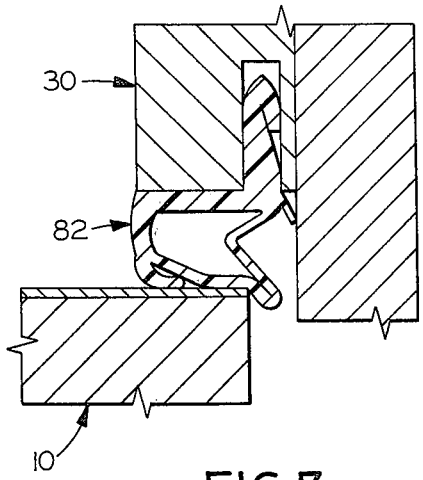
FIG. 7 is a view similar to FIG. 6 showing an alternative embodiment of the weatherseal member.

In the embodiment of FIG. 7, the inner leg of the body portion 86 has been removed to decrease the mass of the weatherseal member 82.

Figure 14:
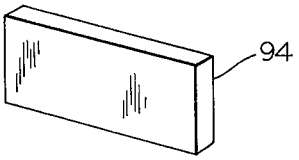
FIG. 14 is a perspective view of the auxiliary weatherseal member in FIG. 10.

As best seen in FIGS. 10 and 14, there is provided on the hinge jamb 30 along the edge of the platform 44 of the sill 36 towards the interior of the frame 12, a second hinge jamb weatherseal member 94 which is a generally rectangular block of highly compressible material. The thickness of the weatherseal member 94 in the uncompressed condition is greater than the spacing between the jamb 30 and side edge 22 of the door 10 so that the door 10 and the sill weatherseal member 54 will press into and deform the material of the weatherseal member 94 thereabout.

Figure 4:
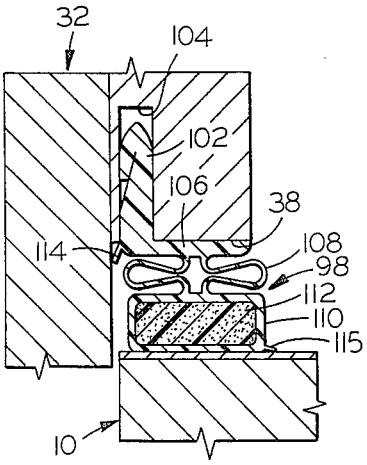
FIG. 4 is a fragmentary sectional view of the door system to an enlarged scale along the line 4—4 of FIG. 1.

Turning now to FIGS. 4, 8, 11 and 13, the latch side of the door 10 is also provided with first and second latch weatherseal members generally designated by the numerals 98 and 100, respectively. The first latch weatherseal member 98 is integrally formed with a barbed tail 102 extending inwardly from the body portion 106 into the channel 104 of the stop 38. A highly flexible bellows portion 108 interconnects the body portion 106 and the box portion 110 which contains a strip of magnetic material 112. The body portion 106 has an inclined tab 114 extending inwardly towards the latch jamb 32, and a tab 115 projects from the outer edge of the box portion 110 towards the door. As seen in FIG. 4, the magnetic strip 112 causes the first latch weatherseal member 98 to tightly seal against the metal skin 20 of the door 10.

Figure 12:
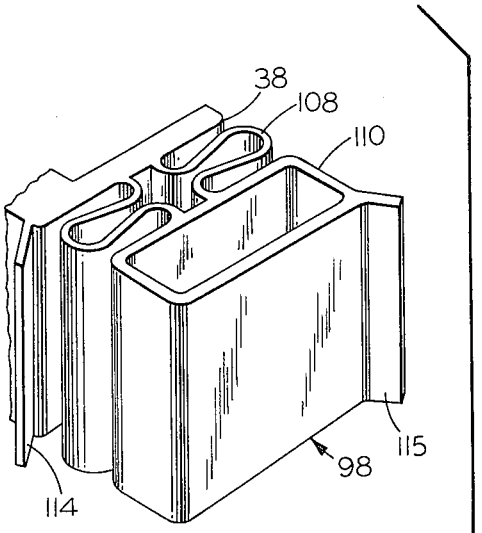
FIG. 12 is a partially exploded perspective view to an enlarged scale of the two weatherseal members illustrated in FIG. 11 but with the magnetic insert omitted.
Figure 13:
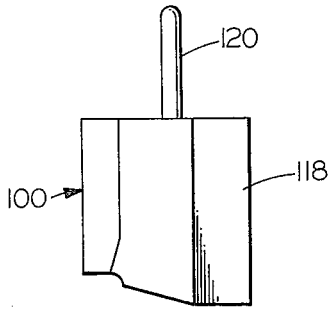
FIG. 13 is an elevational view of the lower weatherseal element of FIG. 12.
Figure 11:
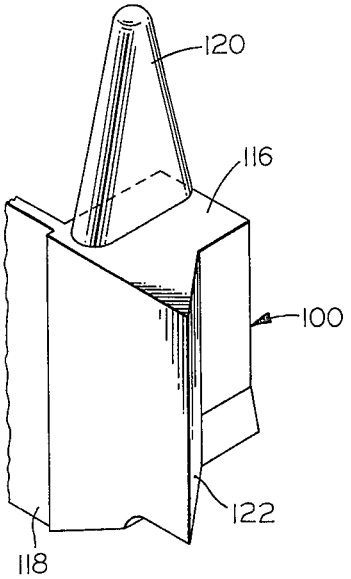
FIG. 11 is a fragmentary sectional view to an enlarged scale of the door system along the line 11—11 of FIG. 1 and showing in phantom line the magnetic weatherseal member at a point during the installation.
Figure 11:
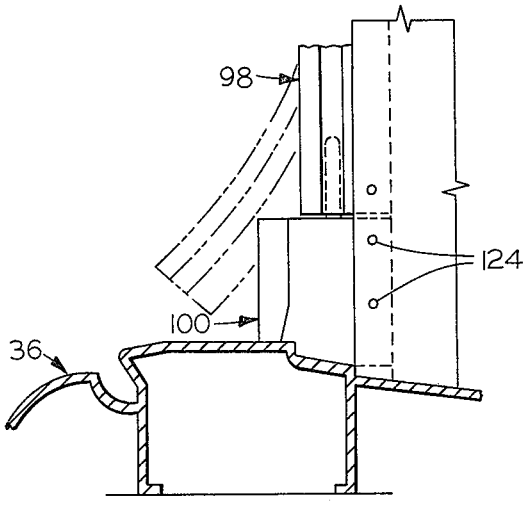

As best seen in FIG. 11, the first latch weatherseal member 98 terminates at a point spaced above the sill 36 and the second latch weatherseal member 100 is disposed immediately therebelow. The second latch weatherseal member 100 is best seen in FIGS. 12 and 13 and is integrally formed of a highly compressible material with the body portion 116 from which projects a lateral mounting arm portion 118 seated in the channel 104 of the stop 38 and a vertically upwardly extending interseal finger portion 120 which extends into the channel defined within the bellows portion 108 of the first latch weatherseal member 98. Projecting laterally in the direction away from the stop 38 is the finger portion 122 which tapers to a reduced cross section at its free end adjacent the jamb 32. In the illustrated embodiment, the lower portion of the second latch weatherseal member 100 conforms to the configuration of the sill 36.

The sill weatherseal member 54 is desirably fabricated as an integral structure from synthetic resins of differing durometer or hardness so that the body portion 58 is a relatively rigid member and the harder resin may be employed for the vertical portion of the tails 56. A more flexible resin is employed for the remainder of the structure and for the barbs upon the tails 56. If so desired, similar dual durometer extrusions may be employed for other weatherseal members although it has been found that resins having a hardness of 60–80 Shore A will normally be satisfactory for the other weatherseal members with the exception of the second hinge jamb weatherseal member 94 and the second latch jamb weatherseal member 100. These preferably employ closed cell foam rubbers or resins of highly resilient compressibility.

In assembling the sill weatherseal member 54 to the bottom edge 28 of the door 10, two channels 59 are routed therein but terminate inwardly from the side edges 22, 24 of the door 10 so as not to interfere with the aesthetic appearance thereof. Portions of the barbed tails 56 corresponding to the lengths of the bottom edge 28 which are not provided with channels 50 are cut away and portions of the deflectors 60 at either end are removed to avoid undue pressure upon the weatherseal members 82, 100.

The weatherseal members 68, 82 and 98 are readily assembled in position by routing the channels 74, 85 and 104 into the cooperating stops 42, 40 and 38 and inserting the barbed tails. Brads or other fasteners 124 are then driven through the stops to lock the tails in position after adjustment relative to the door as seen in FIG. 11.

The second hinge jamb weatherseal member 94 is most conveniently mounted on the jamb 30 by adhesive, and this member may be made with a high strength adhesive coating on its surface with an overlying release paper (not shown) to facilitate assembly. Alternative mounting means may be employed such as nails or the like, but it is extremely desirable that the mounting means avoid excessive deformation of the desired sealing area. This member is dimensioned to extend upwardly at least the vertical spacing of the bottom edge of the door from the sill, and preferably at least about one-half inch thereabove. It desirably extends over substantially the full thickness of the door.

In assembling the latch weatherseal members 98, 100, the weatherseal member 98 is inserted into the channel 104 of the stop 38, and the lower end marked at the desired height above the sill, generally about ¾ to 2 inches. The lower end of the member 98 is removed from the channel and cut off at the marked line. The weatherseal member 100 is then assembled by inserting the interseal portion 120 into the channel defined by the lower end of the bellows portion 108 of the first member 98 and the two members 98, 100 are then pressed inwardly to seat their respective mounting portions 102, 118 in the channel 104 of the stop 38. The brads 124 secure the members in adjusted position.

As seen, the lower edge of the weatherseal member 100 conforms closely to the top surface of the sill 36. Desirably, it is dimensioned somewhat larger than the vertical distance between the weatherseal member 98 and the sill 36 so that it is somewhat compressed along the lower edge when in place.

After the sill and weatherseal members are in position, caulking is desirably applied along the exposed joints between the sill and the jambs. The result is a highly weathertight door system as will now be more fully explained.

In operation of the illustrated embodiment, closing of the door 10 causes the tubular portion 66 at the outer edge of the sill weatherseal member 54 to deflect from the position shown in FIG. 3 to the position shown in FIG. 2. It then bears closely against the upper surface of the platform 44 and it is positioned so that its tab 67 fits tightly against the edge at the outer side of the platform 44. Similarly, the intermediate leg portion 64 is deflected into close fitting engagement with the platform 44. The leg portion 62 abuts the ledge 46 at the inner end of the platform 44 and extends therebelow. As a result, the tubular portion 66 provides a relatively broad sealing area and the leg portions 62, 64 provide secondary sealing portions adequate to trap air or materials which might penetrate the main sealing area. Any water dripping down the face of the door 10 will be deflected outwardly of the seal area by the projecting lips or deflectors 60.

The header weatherseal member 68 is one which depends from the header 34 and its bellows portion 76 permits deflection without causing it to hang down in an unattractive manner. As the door 10 is closed, the magnetic strip 81 in the box portion 78 causes the box portion 78 to seat tightly against the metal skin 20 of the door 10 and the tab 79 is resiliently deflected to enhance the seal. Upon opening movement, it will be seen that the bellows portions 76 allows engagement to be maintained over a limited path of travel.

Turning to the sealing action at the hinge jamb 30, closing movement of the door 10 deflects the Z-shaped web portion 92 from the position shown in FIG. 5 to the position shown in FIG. 6 to provide a substantial area of seal. In addition, the finger 90 is deflected to produce another area of resilient sealing. The embodiment of FIG. 7 is similar in operation but is readily deflectable by removing the one leg of the body portion 86. As the door 10 closes, it and the sill weatherseal member 54 both act upon the second weatherseal member 94 to effect its resilient compression into close resilient bearing with the edges thereof. Thus, the primary sealing at the hinge jamb 30 adjacent the sill weatherseal member 54 is provided by the member 94 and it cooperates with both the sill weatherseal member 94 and the weatherseal member 82 to effect the transition of the sealing function thereto. Water flowing down onto the upper edge of the weatherseal member 94 will flow to the outer edge and draw off since the structure is closed cell.

On the latch side of the door 10, the latch weatherseal member 98 is drawn into firm contact with the metal skin 20 of the door 10 by action of the magnetic strip 112, and the bellows portion 108 collapses as the door 10 seats tightly in the frame 12. It can be seen that the lip 115 on the box portion 110 also deflects to enhance the sealing action. At the lower end of the jamb 32, the door 10 compresses the second sealing member 100 and causes the finger portion 122 to deflect away from the jamb 32 and against the edge 24 of the door 10. Because the weatherseal members 98, 100 are interconnected by the interseal portion 120, an effective seal is provided therebetween and a transition in sealing action is effected. The sill weatherseal member 54 similarly effects a compressive deflection of the weatherseal member 100 to produce a weathertight seal therebetween.

Illustrative of the efficacy of the illustrated door system are the following test data. In the air infiltration test ASTM E 283, the door system was found to permit passage of only 0.0225 cubic foot of air per minute per lineal foot of crack as contrasted with the passing criterion of 0.75 cubic foot. In the water leakage test ASTM E 331, the door system showed zero water leakage for 15 minutes at 50 miles per hour wind load whereas the test itself requires only 34 miles per hour wind loading.

As will be appreciated, the weatherseal system of the present invention may be used with either metal or metal-clad doors or with conventional wooden and resin clad clad doors. With the former types, magnetic strips provide enhanced sealing action even when the door vibrates within the frame under high wind loadings. Typical metal-clad doors may use wood cores, plastic cores or wood/plastic composite cores to provide good thermal barrier properties.

Although the door in the illustrated embodiment opens inwardly of the building, the weatherseal members may be employed with outwardly opening doors, preferably with an alternate configuration for the sill and a reversal of the sill weatherseal member. The configuration of the several weatherseal members may vary from those illustrated so long as the same principles of intercontact are maintained.

From the foregoing detailed specification and drawings, it can be seen that the door system of the present invention provides highly effective sealing action against wind and water infiltration, even under high wind loadings. The components may be readily fabricated and assembled, and magnetic strips may be used to enhance sealing action if so desired.

Having thus described the invention, we claim:

1. In a weathersealed door system, the combination comprising:

A. a door frame including a pair of spaced jambs, a sill and a header;

B. a door in said frame;

C. hinge means mounting one side edge portion of said door to one of said jambs for pivotal movement from a first position within said frame to a second position wherein the opposite side edge portion of said door is disposed outwardly therefrom;

D. a sill weatherseal member extending along the bottom edge of said door, said sill weatherseal member including a tubular depending portion extending along the width of said door, said depending portion being of a height greater than the spacing between said bottom edge of said door and said sill and being deflected into close engagement with the surface of said sill in said first position of said door;

E. a header weatherseal member extending across the top edge of said door and being resiliently deflected in said first position of said door;

F. a first hinge jamb weatherseal member extending along the jamb to which said hinge means is mounted from said header weatherseal member to said sill;

G. a second hinge jamb weatherseal member extending upwardly from said sill and adjacent said first hinge jamb weatherseal member, said second hinge jamb weatherseal member being fabricated of highly compressible material and of a thickness greater than the spacing between the side edge of the door and the jamb so that it is compressed when said door is in said first position by both the side edge of said door and said sill weatherseal member;

H. a first latch jamb weatherseal member on the jamb opposite that having said hinge means mounted thereon and extending from adjacent said header to a point spaced above said sill, said latch jamb weatherseal member having a cross section providing a first portion mounted on the jamb and a deflectable portion laterally therefrom for engagement with the surface of said door in said first position thereof and providing an internal channel at least adjacent the sill end thereof; and I. a second latch jamb weatherseal member mounted on said opposite jamb and extending upwardly from said sill below said first latch jamb weatherseal member, said second latch jamb weatherseal member having a cross section providing a body portion, a deflectable lip portion projecting laterally from said body portion towards the door and an interseal portion projecting upwardly into said channel of said first latch jamb weatherseal member, said second latch jamb weatherseal member being fabricated of highly compressible material and being compressed by said door in said first position thereof with said lip portion abutting the side edge of the door.

2. The weathersealed door system in accordance with claim 1 wherein said sill weatherseal member tubular depending portion is of generally rectangular cross section with the lower face thereof snugly seating against the cooperating face of said sill.

3. The weathersealed door system in accordance with claim 2 wherein said sill has a ledge extending along the length thereof at its inner edge and said sill weatherseal member has a second depending portion abutting the surface of said ledge of said sill and extending therebelow.

4. The weathersealed door system in accordance with claim 2 wherein said sill weatherseal member has a resiliently deflectable tab portion extending along the outer edge of said tubular portion and wherein said sill has a step therein against which said tab bears.

5. The weathersealed door system in accordance with claim 3 wherein said sill weatherseal member has an intermediate depending portion of a height greater than the spacing between said door and said sill and deflected into close engagement with the surface of said sill in said first position of said door.

6. The weathersealed door system in accordance with claim 2 wherein said sill weatherseal member is of greater transverse dimension than the thickness of said door so as to project beyond the principal surfaces thereof and provide drip caps.

7. The weathersealed door system in accordance with claim 1 wherein said header weatherseal member has a mounting portion for attachment to said header and a tubular portion at the free end thereof.

8. The weathersealed door system in accordance with claim 7 wherein said header weatherseal member has a resiliently deflectable bellows portion between said mounting portion and said tubular portion and wherein there is included a strip of magnetic material within said tubular portion.

9. The weathersealed door system in accordance with claim 1 wherein said first hinge jamb weatherseal member includes a mounting portion and a compressible tubular portion.

10. The weathersealed door system in accordance with claim 9 wherein said compressible tubular portion of said first hinge jamb weatherseal member includes a resiliently deflectable finger portion at the edge thereof spaced from said jamb and towards said door, said deflectable finger portion being inwardly deflected by said door in said first position thereof.

11. The weathersealed door system in accordance with claim 1 wherein said second hinge jamb weatherseal member extends over substantially the entire thickness of said door from adjacent said first hinge jamb weatherseal member.

12. The weathersealed door system in accordance with claim 1 wherein said first latch jamb weatherseal member deflectable portion includes a tubular portion at the outer end thereof.

13. The weathersealed door system in accordance with claim 12 wherein said first latch jamb weatherseal member deflectable portion includes a bellows portion between said first portion and said tubular portion.

14. The weathersealed door system in accordance with claim 12 wherein said tubular portion has a strip of magnetic material therein.

15. The weathersealed door system in accordance with claim 12 wherein said tubular portion of said first jamb weatherseal member includes a deflectable finger projecting from the edge thereof spaced from said jamb and said first position, said finger being deflected into surface contact with said door in said first position thereof.

16. The weathersealed door system in accordance with claim 1 wherein said jamb weatherseal member cross section provides a mounting portion projecting laterally from said body portion in the direction opposite from said lip portion.

17. The weathersealed door system in accordance with claim 1 wherein said deflectable lip portion on said second latch jamb weatherseal member has a vertical surface adjacent the edge of said door tapering to a reduced cross section at the free end thereof.

18. A latch jamb weatherseal assembly comprising an elongated first latch jamb weatherseal member having a cross section providing a first portion for mounting on a latch jamb and a deflectable portion for engagement with the surface of an associated door, said cross section providing an internal channel within said deflectable portion; and a second latch jamb weatherseal member having a cross section providing a body portion, a deflectable lip portion projecting laterally from the body portion in the same direction as said deflectable portion of said first latch jamb weatherseal member, and an interseal portion projecting upwardly into said channel of said first latch jamb weatherseal member, said second weatherseal member being fabricated of highly compressible material for compression by the associated door in the closed position thereof.

19. The latch jamb weatherseal assembly in accordance with claim 18 wherein said first weatherseal member deflectable portion includes a tubular portion at the outer end thereof and a bellows portion between said first portion and said tubular portion; and wherein said second weatherseal member interseal portion extends upwardly into the channel defined by said bellows portion.

20. The latch jamb weatherseal assembly in accordance with claim 18 wherein said second weatherseal member deflectable lip portion has a vertical surface tapering to a reduced cross section at the free end thereof.

21. The latch jamb weatherseal assembly in accordance with claim 18 wherein said second weatherseal member cross section provides a mounting portion projecting laterally from said body portion in the direction opposite from said lip portion thereof.

* * * * *